US007730697B2

(12) United States Patent
Bernardi et al.

(10) Patent No.: US 7,730,697 B2
(45) Date of Patent: Jun. 8, 2010

(54) AUTOMATIC MACHINE FOR MAKING FILTER BAGS FOR INFUSION PRODUCTS

(75) Inventors: Matteo Bernardi, Imola (IT); Dario Rea, Monterenzio (IT)

(73) Assignee: IMA Flavour S.R.L., Ozzano Emilia (IT)

( * ) Notice: Subject to any disclaimer, the term of this patent is extended or adjusted under 35 U.S.C. 154(b) by 27 days.

(21) Appl. No.: 12/298,107

(22) PCT Filed: May 21, 2007

(86) PCT No.: PCT/IB2007/001444

§ 371 (c)(1),
(2), (4) Date: Oct. 22, 2008

(87) PCT Pub. No.: WO2007/138471

PCT Pub. Date: Dec. 6, 2007

(65) Prior Publication Data

US 2009/0241468 A1 Oct. 1, 2009

(30) Foreign Application Priority Data

May 31, 2006 (IT) ..... BO2006A0422

(51) Int. Cl.
*B65B 35/40* (2006.01)

(52) U.S. Cl. ..... 53/152; 53/443; 53/147; 53/542; 53/544

(58) Field of Classification Search ..... 53/147, 53/152, 153, 531, 534, 542, 544, 443
See application file for complete search history.

(56) References Cited

U.S. PATENT DOCUMENTS

| | | | | |
|---|---|---|---|---|
| 3,815,316 | A * | 6/1974 | Brooke | 53/437 |
| 3,876,083 | A | 4/1975 | Evans et al. | |
| 4,718,534 | A * | 1/1988 | Harper | 198/401 |
| 5,311,724 | A * | 5/1994 | Vernon et al. | 53/529 |
| 5,548,945 | A * | 8/1996 | Nippes | 53/540 |
| 6,041,578 | A * | 3/2000 | Romagnoli | 53/540 |
| 6,637,175 | B2 | 10/2003 | Ghirlandi | |
| 2002/0139087 | A1 | 10/2002 | Ghirlandi | |

FOREIGN PATENT DOCUMENTS

| | | | |
|---|---|---|---|
| DE | 1001944 | B | 1/1957 |
| EP | 0488794 | A2 | 6/1992 |
| GB | 2165203 | A | 4/1986 |
| WO | WO9741032 | A | 11/1997 |
| WO | WO0162600 | A | 8/2001 |

* cited by examiner

*Primary Examiner*—Christopher Harmon
(74) *Attorney, Agent, or Firm*—Pearne & Gordon LLP

(57) ABSTRACT

A machine (100) for making filter bags (1) for infusion products, the machine (100) being of the type comprising, one after the other along a production line (P), a plurality of operating stations designed to form the filter bags (1) and at least one operating outfeed station (7) for handling the filter bags (1) made; the operating outfeed and handling station (7) comprises conveying means (8) designed to successively pick up and withhold the filter bags (1) along a certain section (T1) of the line (P); supporting guide means (9) along which an ordered and continuous succession of filter bags (1) is formed and fed along another section (T2) of the line (P); and means (11) for picking up and transferring the filter bags from the conveying means (8) to the supporting guide means (9).

13 Claims, 5 Drawing Sheets

AUTOMATIC MACHINE FOR MAKING FILTER BAGS FOR INFUSION PRODUCTS

TECHNICAL FIELD

This invention relates to an automatic machine for making filter bags for infusion products such as tea, coffee, camomile and the like.

In particular, the invention is advantageously used for making groups of products defined by a predetermined number of filter bags each containing a charge of infusion product, preferably tea or the like, to which this specification expressly refers but without thereby restricting the scope of the invention.

BACKGROUND ART

Usually, automatic machines for packaging/making filter bags comprise a plurality of operating stations located one after the other along respective production lines where the filter bags are made, each filter bag containing a charge of infusion product enclosed in a chamber of the filter bag.

Depending on the type of product and machine, the filter bags may have one or two chambers and may be associated, using any of several known methods (such as knotting, heat-sealing or application of heat-sealable stamp) with a tie string that connects the filter bag to a tag joined to the free end of the string in any of several different ways (for example, knotting, heat-sealing or application of a stamp).

The tie string and tag are placed on the filter bag (for example, wound around the filter bag or placed between the two chambers) to form a product that is ready to be grouped and suitably stacked in the area at the end of the production line where there is a filter bag stacking station, usually followed by a final packaging station which places the stacks or groups of stacks of filter bags in suitable containers or cartons. In many cases, before the filter bags are stacked, they are overwrapped with individual wrappers, each suitably folded into the shape of a U around a filter bag and sealed to form the typical envelope-like packet containing the filter bag.

At present, depending on circumstances and on the place where the tea-bag making machine is to be used, especially if low-cost labour is available, manufacturers of automatic tea-bag machinery are opting more and more for "simplified" solutions, where the filter bags are packaged manually, thus avoiding the need to provide machines with automated end-of-line packaging stations and thus reducing costs and saving factory floor space.

For this purpose, the tea bag malting machine must be provided with an end-of-line station designed to feed out the filter bags (with or without overwrap) at a regular rate, in succession, at some distance from the machine, and in such a way that production operators can easily pick them up manually.

In addition to this, the outgoing filter bags must be divided up into well-defined successive groups along the feed line of the end-of-line station (each group containing a predetermined number of filter bags which may, however, be changed when necessary), so that the operator can pick them up easily and without hesitation, knowing exactly that the groups contain the right number of filter bags to be placed in the cartons.

The Applicant's aim was therefore to design an automatic machine for malting filter bags for infusions products, whose structure comprises an end section with a product outfeed station adapted to form groups containing predetermined numbers of filter bags which can be picked up manually, without altering the basic structure and productivity of the machine and maintaining the machine's high level of performance, dependability and adaptability.

DISCLOSURE OF THE INVENTION

This invention accordingly provides a machine for making filter bags for infusion products, the machine being of the type comprising, one after the other along a production line, a plurality of operating stations designed to form the filter bags and at least one operating outfeed station for handling the filter bags made; the machine being characterised in that the operating outfeed and handling station comprises conveying means designed to successively pick up and withhold the filter bags along a certain section of the line; supporting guide means along which an ordered and continuous succession of filter bags is formed and fed along another section of the line; and means for picking up and transferring the filter bags from the conveying means to the supporting guide means.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
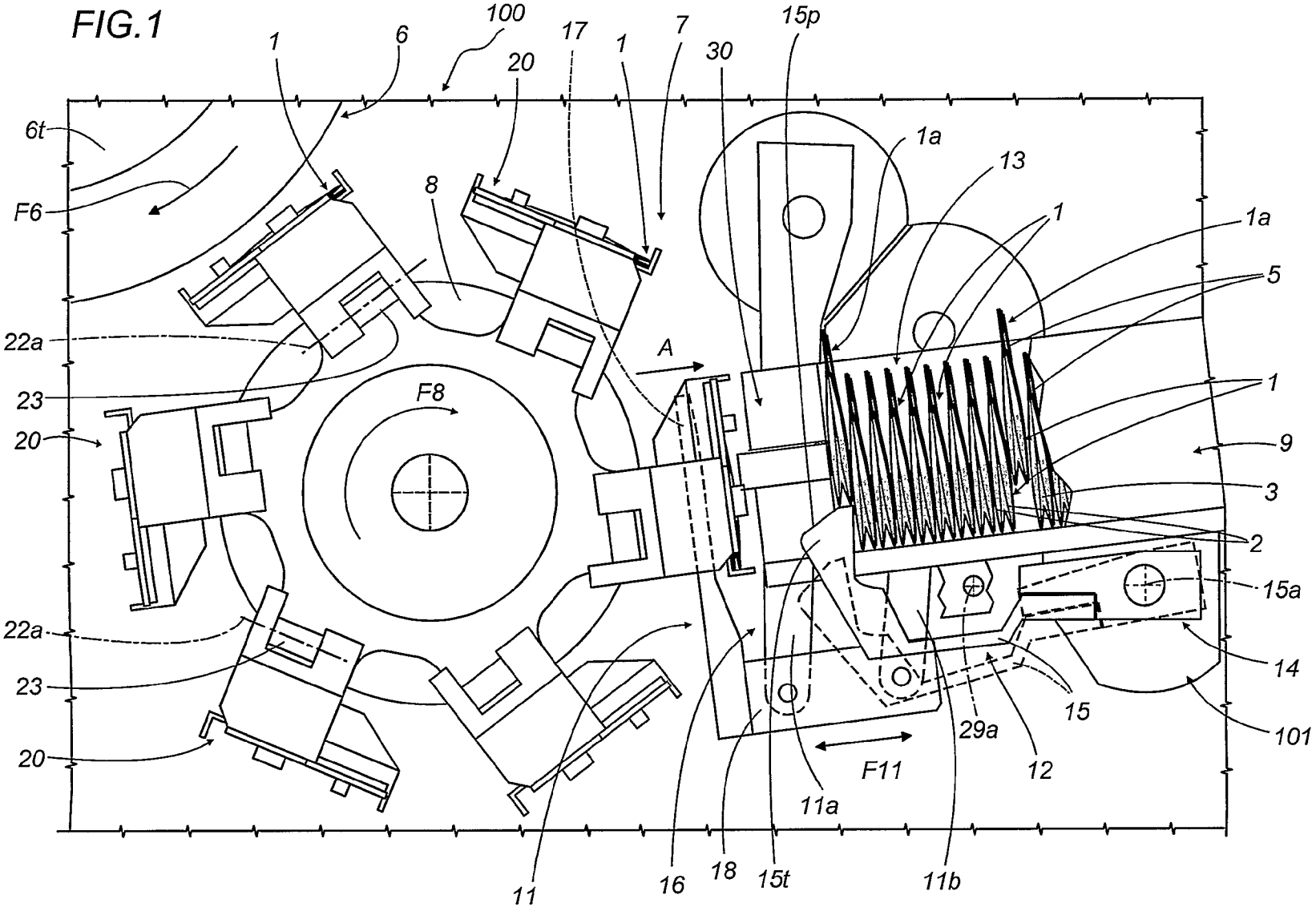
FIG. 1 is a schematic side view, with some parts cut away in order to better illustrate others, of an end or end-of-line section of an automatic packaging machine for making filter bags for infusion products.
Figure 2:
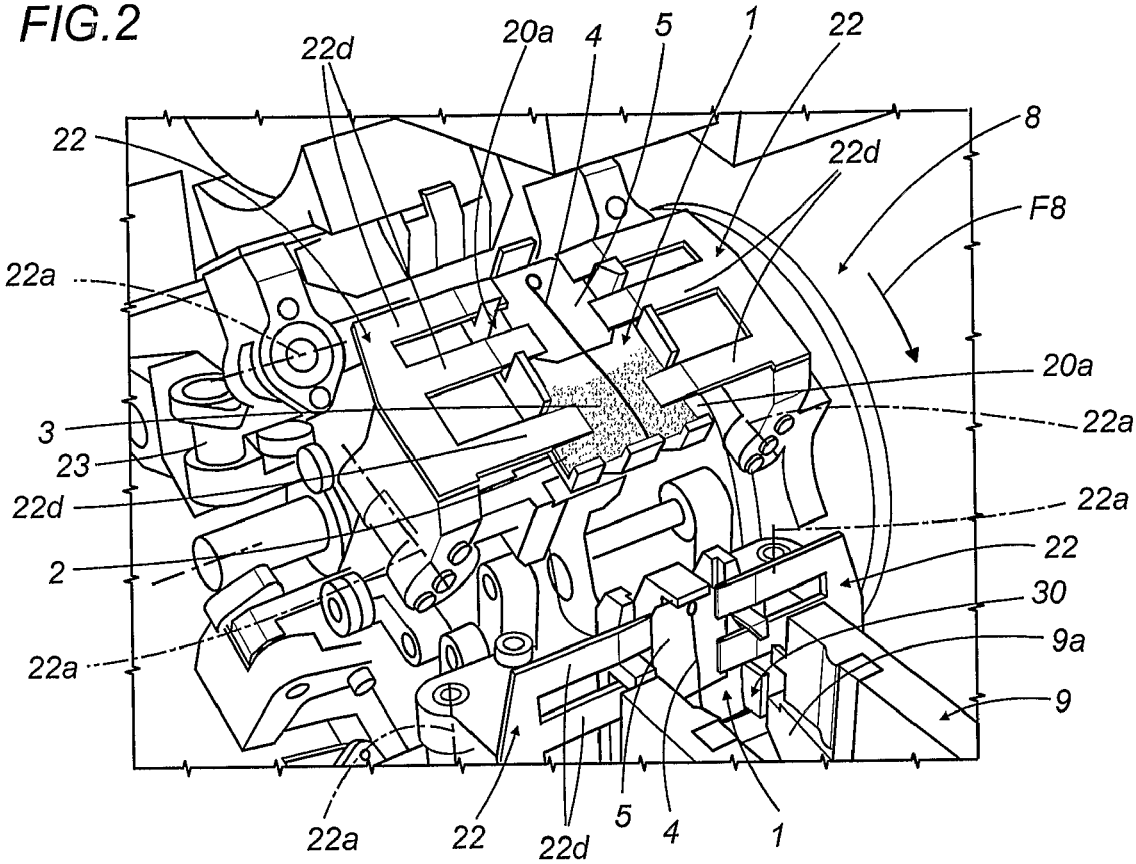
FIG. 2 is a front perspective view of a working detail of the outfeed part of the machine of FIG. 1.

With reference to the accompanying drawings, in particular FIGS. 1 and 2, the machine according to the invention, labelled 100 in its entirety, is used for making filter bags 1 for infusion products, such as tea, coffee, camomile and the like.

Preferably, but not necessarily, the filter bag 1 is of the type comprising: one chamber 2 containing one charge 3 of infusion product; a tie string 4 joined at one end to the chamber 2; and a tag 5 joined to the other end of the tie string 4. Obviously, the filter bags 1 made and handled by the machine may be of the type without tag and tie string, without thereby restricting the scope of the invention.

The machine 100 is of the type comprising, one after the other along a production line P, a series of known operating stations (not described and illustrated in detail since they are not relevant to the invention) designed to form the filter bags 1, join each filter bag 1 to the tie string 4, join the tag 5 to the tie string 4 and then arrange the tie string 4 and the tag 5 on the filter bag 1.

As better illustrated in FIG. 1, the machine 100 also comprises an intermediate station 6 for picking up and transferring the finished filter bag 1 to an end-of-line filter bag 1 handling station or unit 7.

The intermediate station 6 is defined by a known drum 6*t* for picking up and moving the filter bags 1.

As illustrated in FIGS. 1 to 6, the above mentioned end-of-line unit 7, which this invention is specifically concerned with, comprises: a first conveying element 8 for picking up each single filter bag 1 as it arrives from the intermediate station 6, feeding the filter bag 1 along a section T1 of the line P and positioning it on a supporting channel 9 that transports an ordered and continuous succession of filter bags 1 along a straight section T2 of the line P to a handling area 10 (FIG. 6) where they can be picked up manually and subsequently packaged, for example by placing them manually in suitable cartons; means 11 for picking up each filter bag 1 from the first conveying element 8 and moving the filter bag 1 within the channel 9 in a feed direction A along the section T2 in such a way as to produce a continuous succession of filter bags 1 in the channel 9.

FIG. 1 also shows that the unit 7 further comprises actuating means 12 for defining a reference or separator between two consecutive sets of a predetermined number of filter bags 1 in order to form separate groups 13 of filter bags 1 to be picked up manually from the channel 9.

In particular, the means 12 are located in the vicinity of the end of the channel 9 where the filter bags 1 from the first element 8 are fed in.

As illustrated in FIGS. 1 to 5, the first pick-up element 8 consists of a first rotating conveyor drum 8 (arrow F8, FIG. 1) located in the vicinity of the second drum 6*t* for moving the filter bags 1 (the rotation direction of the second drum 6*t* being indicated by the arrow F6) in such a way as to receive single filter bags 1 from the second drum 6*t*.

The first drum 8 has a plurality of cells 20, uniformly distributed on its circumferential surface, for receiving the individual filter bags 1, released by the second drum 6*t* and transporting the filter bags 1 to a position close to the channel 9.

Each of the cells 20 has two longitudinal grooves 21 (FIGS. 3 and 4) which, when the cell 20 passes near the infeed end of the channel 9, accommodate two vertical teeth 17 constituting, as described in more detail below, the aforementioned means 11 for picking up each filter bag 1.

In addition to that, each cell 20 on the drum 8 has a finger unit 22 on each side of it for retaining the filter bag 1 in the cell 20.

Figure 3:
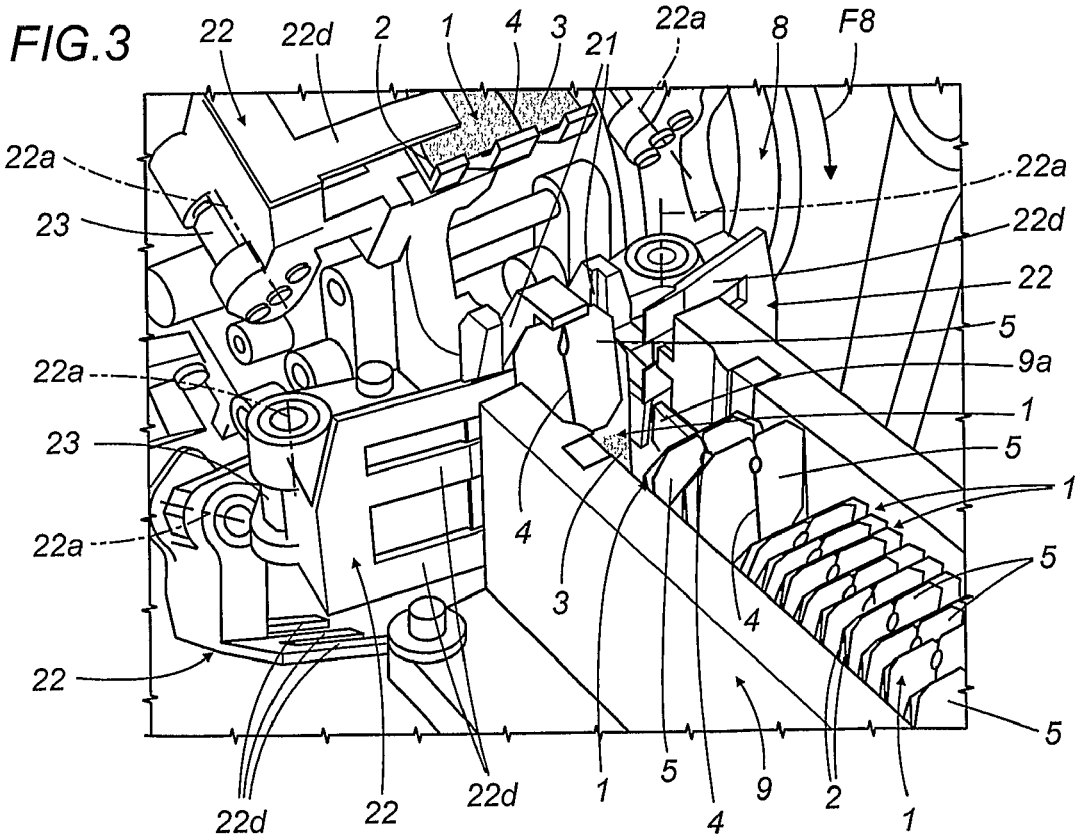
FIGS. 3, 4 and 5 are perspective views from above, with some parts cut away in order to better illustrate others, showing three different working positions of respective operating elements located at the outfeed part of the machine of FIG. 1.
Figure 4:
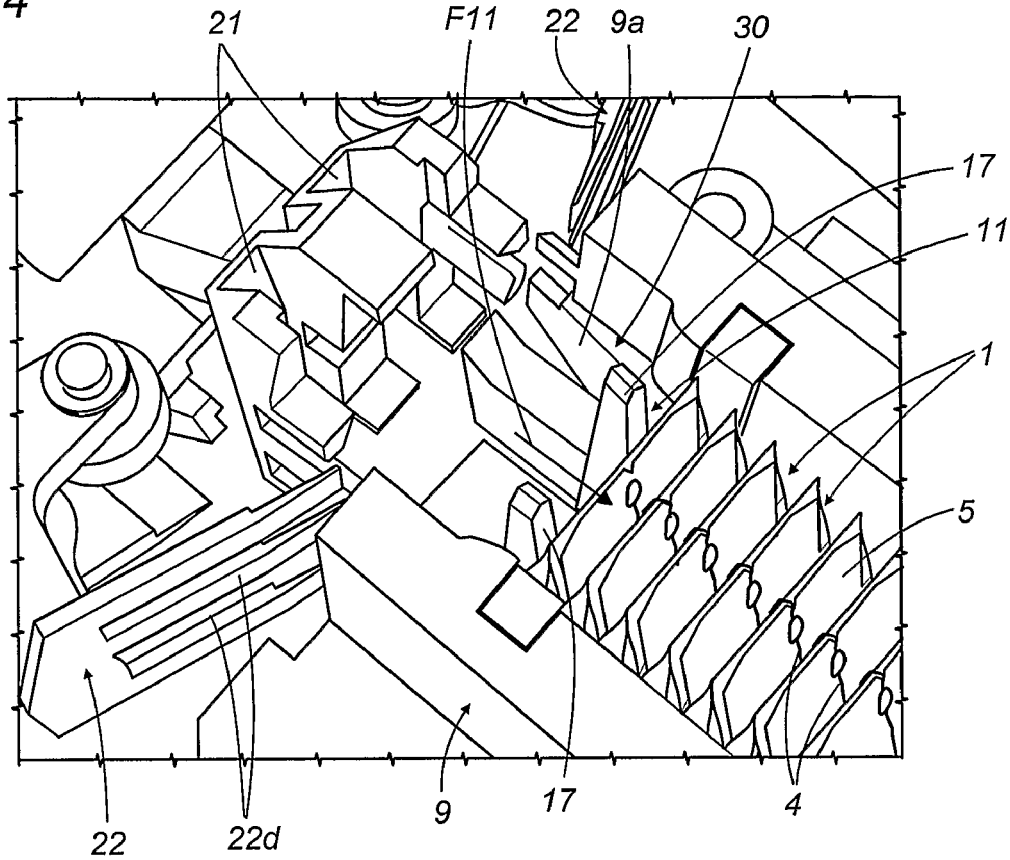

Each finger unit 22 is pivoted, at 22*a* (FIGS. 1, 2 and 3), to a rigid arm 23 protruding laterally from the first drum 8: thus, each finger unit 22 can be turned from a first, closed retaining position, where the finger unit 22 at least partially faces the filter bag 1 located in the cell 20 and engages, with its fingers 22*d*, respective lateral openings 20*a* in the cell 20 (FIG. 2), and an open position for feeding/releasing the filter bag 1, where each finger unit 22 is away from the cell 20 (FIGS. 2 to 4).

Again with reference to FIGS. 1 to 5, the pick-up means 11 comprise a filter bag 1 ejector element 11 located between the first pick-up drum 8 and the channel 9 infeed area.

The ejector element 11 is driven in the feed direction A (arrow F11, FIG. 1), by respective means 16 (partly visible in FIG. 1 as two levers 11*a*, 11*b* of a four-bar linkage connected to a cam system that synchronises it with the first drum 8) between a first pick-up position, where the ejector element 11 is positioned between the first pick-up element 8 and a respective filter bag 1 (see FIGS. 1 and 5), and a release position, where the ejector element 11 is inside the channel 9, with the filter bag 1 positioned between the walls 9*a* of the channel 9 (see FIG. 4), and vice versa.

As stated above, the ejector element 11 comprises a pair of vertical teeth 17 for pushing the filter bag 1, associated with a base 18, in such a way as to form, together with the teeth 17, a U shaped element controlled by the cam system 16 which drives it and coordinates its motion, from the pick-up position to the release position and vice versa.

Figure 5:
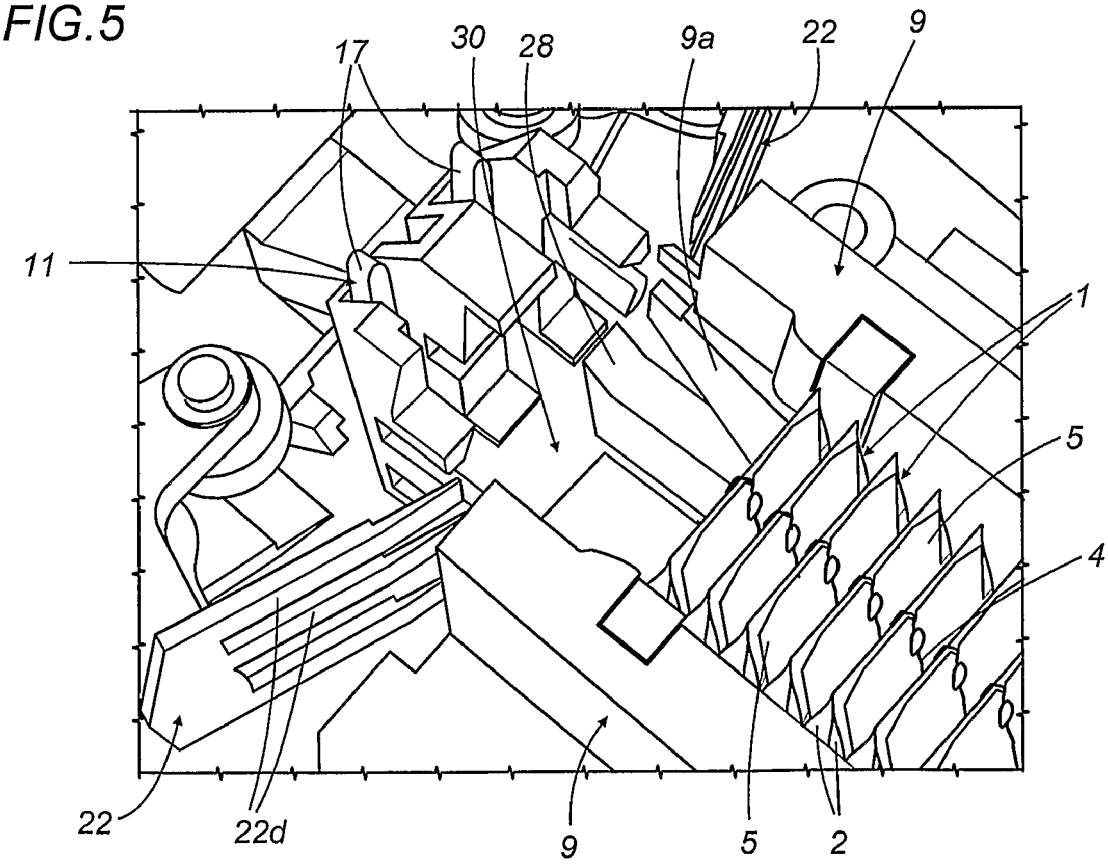
Figure 6:
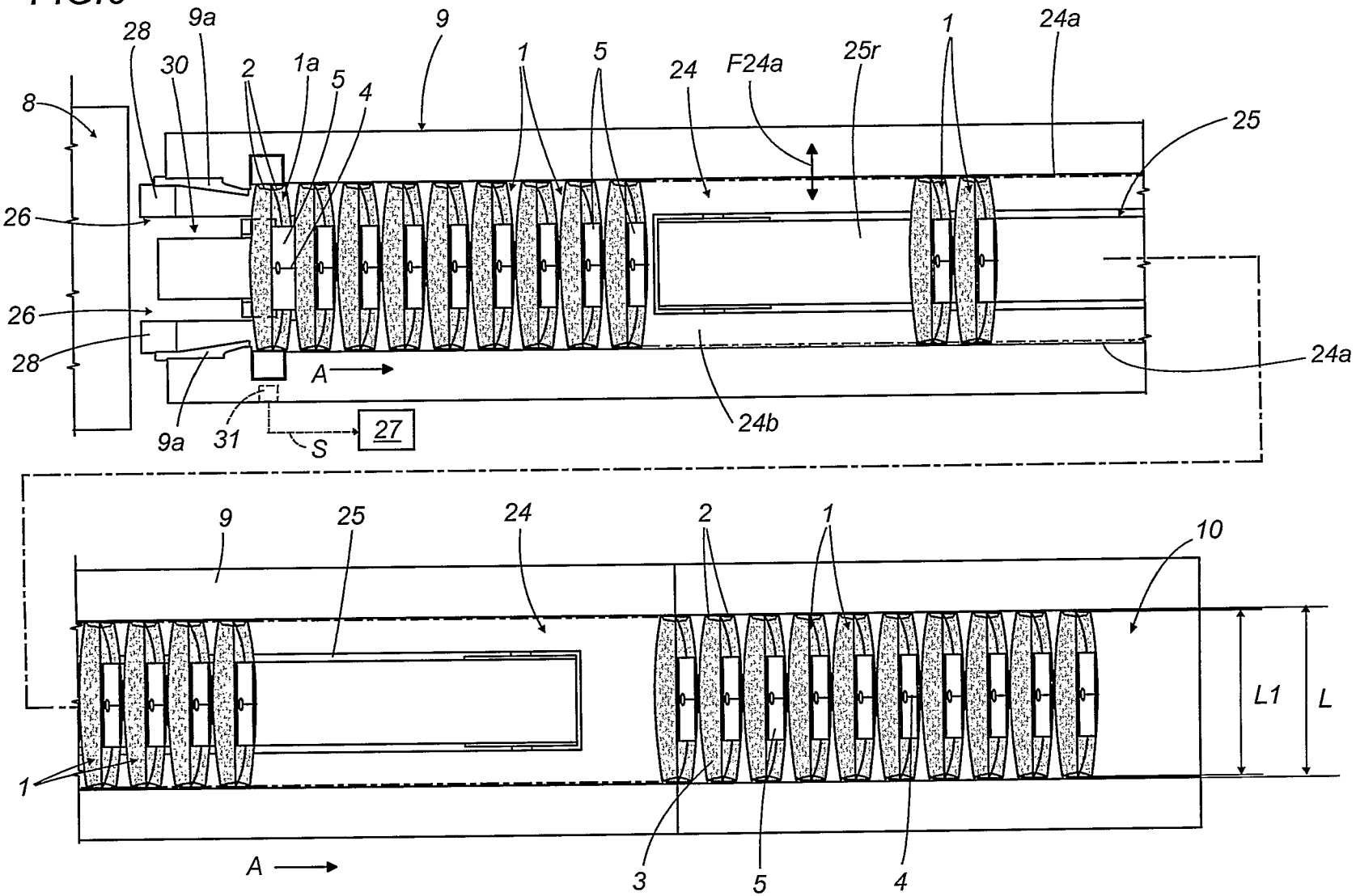
FIG. 6 illustrates a detail from FIG. 1 in a plan view from above.

As illustrated in FIGS. 4, 5 and 6, the channel 9 may be composed of a first, infeed section 30 having side walls 9*a* converging towards the inside of the channel 9 itself and designed to retain the filter bag 1 temporarily in the infeed area, and a successive second section 24 whose passage width L is at least equal to the width L1 of the filter bags 1 in transit.

Further, the base 24*b* of the second section 24 at least partly cooperates with a portion 25*r* of a power-driven conveyor belt 25 designed to permit the movement of the filter bags 1 in the feed direction A towards the manual pick-up and handling area 10.

The second section 24 may also be equipped with respective side walls 24*a* that can be moved (using customary mechanisms) in order to adjust the passage width L according to the width L1 of the filter bags 1 (arrows F24*a*).

As clearly illustrated in FIG. 1, the actuating means 12 consist of means 12 for lifting a predetermined incoming filter bag 1*a* with respect to the other filter bags 1 in order to define the above mentioned reference.

The means 12 are located under the channel 9 and, when required, are operated upon by respective drive means 14 (comprising a customary cam system, not illustrated) in such a way as to act on the bottom of the single filter bag 1*a* so that the latter moves upwards.

Again with reference to FIG. 1, the means 12 may comprise a lever 15, located under the plane defined by the channel 9 and pivoted, at 15*a* at one end of it, to a frame 101 in such a way as to move, when acted upon by the drive means 14, between an idle position (dashed line in FIG. 1) where the lever 15 is away from the channel 9, and a working position where the lever 15 rises and with its free end engages an opening in the channel 9 in such a way as to contact and raise the predetermined filter bag 1*a* (continuous line in FIG. 1).

At its free end, the lever 15 has a wedge-shaped head 15*t* forming an inclined surface 15*p*, and whose upper vertex is away from the infeed area of the channel 9 so that when the lever 15 is in the raised position, the filter bag 1*a* is lifted as it goes in.

Figure 7:
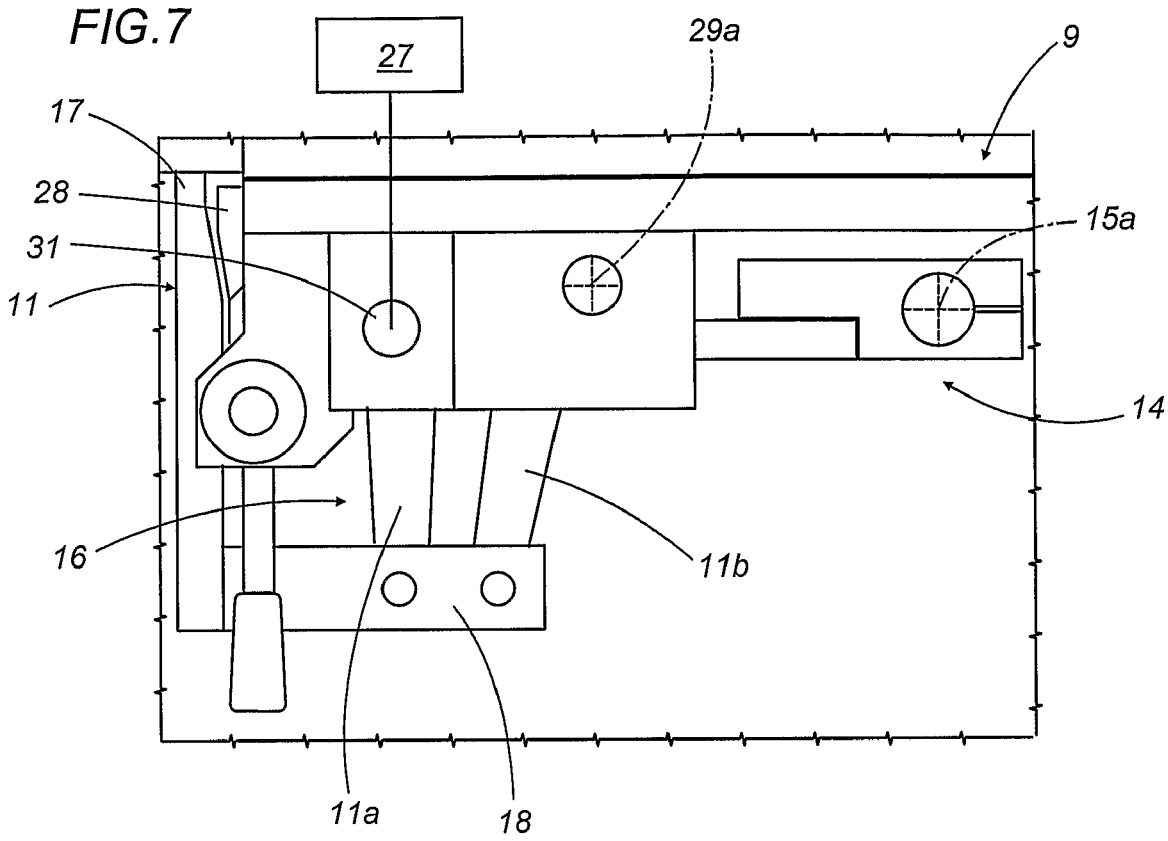
FIGS. 7 and 8 are schematic side views showing two further operating elements of the machine according to the invention in two different working configurations.
Figure 8:
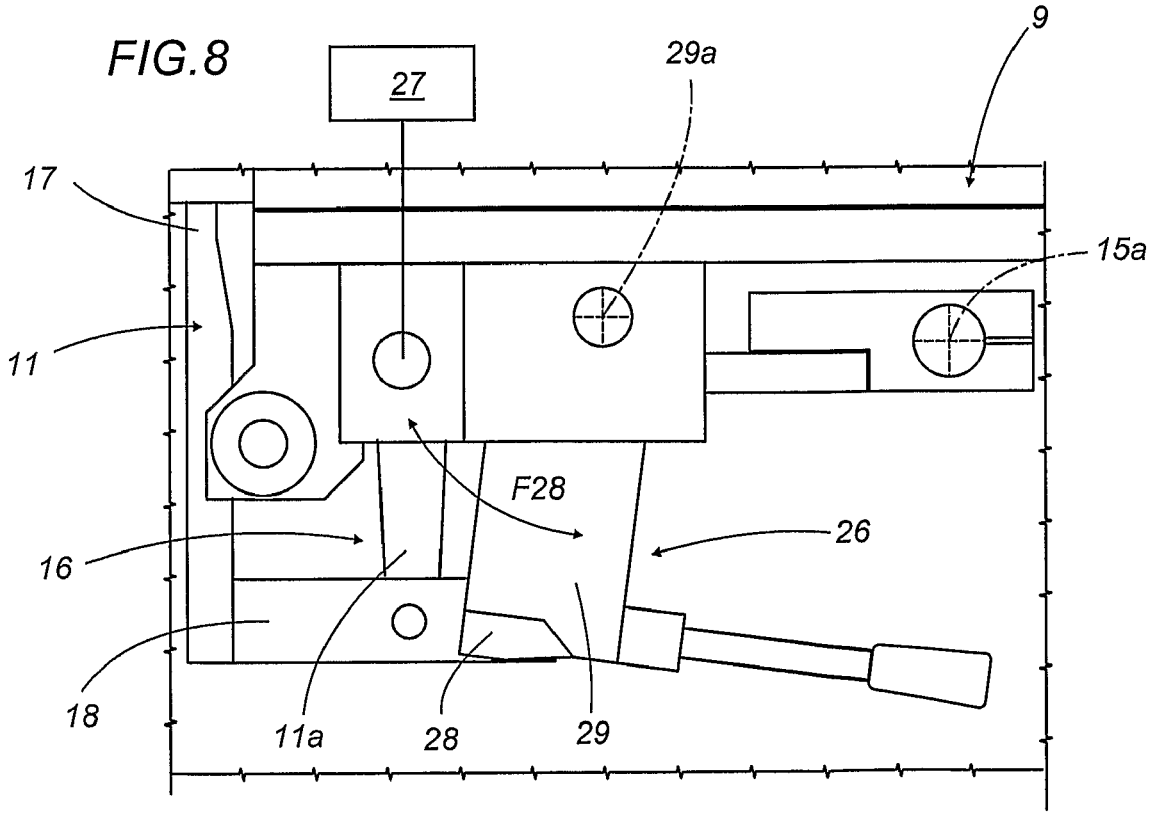

As illustrated in FIGS. 7 and 8 and partly also in FIGS. 4 and 5, the unit 7 comprises safety means 26 located close to the infeed end of the channel 9, acting on a main control unit 27 of the machine 100 (illustrated as a generic block) and designed to produce a signal that stops the machine 100 in the event of a fault in the mechanism that moves/feeds the filter bags 1 into the channel 9.

More specifically, the safety means 26 comprise a pair of parallel control rods 28 associated with a block 29 linked to the channel 9.

The rods 28 are coupled, by interference, with the respective side walls 9*a* of the infeed area of the channel 9 so that, when the machine 100 is working normally at steady state, they are parallel with the channel 9 on both sides of the pick-up means 11 and underneath the area where the filter bags 1 pass (see FIGS. 4, 5 and 7).

The support block 29 is pivoted, at 29*a* at one end of it, to the channel 9 so as to allow the rods 28 to rotate if the filter bags 1 get jammed in the infeed area of the channel, thereby exerting on the rods 28 a downward pushing force that is greater than the retaining force exerted by the rods 28 on the walls 9*a* of the channel 9 (FIG. 8 and arrow F28).

A presence sensor, labelled 31, associated with the channel 9 and located near the pair of rods 28 when they are parallel to the channel 9, generates a machine 100 stop signal S when the rods 28 are rotated downwards.

The machine 100 described above works in the following manner.

Each single filter bag 1 present on the first drum 6*t* is individually released into a respective cell 20 in the second drum 8 as the two drums rotate concordantly (see FIG. 1 and arrow F6).

Once the filter bag 1 has been received, the finger units 22 are closed over the cell 20 in order to hold in the filter bag 1 (see FIG. 2).

As the second drum 8 rotates, each cell 20 is in turn aligned with the infeed area of the channel 9; as each cell 20 approaches, the teeth 17 (held in the first pick-up position) are positioned between the cell 20 and the filter bag 1 thanks to the presence of the grooves 21, and, at the same time, the finger units 22 move back to the open position (see FIG. 3).

At this point, the teeth 17 are moved in the feed direction A in such a way as to push the filter bag 1 into the channel 9 (see FIG. 4). Here, the converging side walls 9*a* help keep the filter bag 1 in place.

The teeth 17 are then moved back to the pick-up position within the cell 20 which has just been cleared and is being held in the waiting position. Only then does the first drum 8 start turning again to perform another feed step.

When a certain number of filter bags 1 have been fed in, the lever 15 is activated to lift the filter bag 1*a* defining the separating element (or "flag") between two consecutive groups of filter bags 1 to be picked up manually (see FIG. 1).

As the filter bags 1 are fed in, they form a continuous row of filter bags 1 which push each other along the channel 9 until they reach the conveyor belt 25 which receives and feeds them to the manual pickup-up and handling area 10.

If the filter bags 1 being fed into the channel 9 get jammed, so that the filter bag 1 at the infeed area prevents the filter bags 1 following it from advancing, the build up causes the teeth 17 to push the filter bags 1 until the force exerted on them is sufficient to push the rods 28 downwards, thereby bringing the machine 100 to a stop.

A machine made as described above achieves the aforementioned aims thanks to an extremely simple end-of-line structure that is inexpensive to produce and yet capable of effectively feeding the filter bags at a fast and regular rate.

To this must be added the capability of dividing the filter bags into predetermined groups that are easy to distinguish and can be more easily picked up by hand or using suitable mechanical means.

The invention described can also be modified and adapted in several ways without thereby departing from the scope of the inventive concept. Moreover, all the details of the invention may be substituted by technically equivalent elements.

The invention claimed is:

1. A machine (100) for making filter bags (1) for infusion products, the machine (100) being of the type comprising, one after the other along a production line (P), a plurality of operating stations designed to form the filter bags (1) and at least one operating outfeed station (7) for handling the filter bags (1) made; the operating outfeed and handling station (7) comprising:

conveying means (8) designed to successively pick up and withhold the filter bags (1) along a certain section (T1) of the line (P);

supporting guide means (9) along which an ordered and continuous succession of filter bags (1) is formed and fed along another section (T2) of the line (P); and means (11) for picking up and transferring the filter bags from the conveying means (8) to the supporting guide means (9);

the machine (100) further comprising actuating means (12), positioned and operating at the supporting guide means (9) in such a way as to define a reference (1*a*) between two consecutive sets of a predetermined number of filter bags (1) in order to form respective groups (13) of filter bags (1) to be picked up from the supporting guide means (9);

wherein the actuating means (12) comprise means (12) for lifting a predetermined filter bag (1*a*) with respect to the other filter bags (1) in order to define said reference, the actuating means (12) being located under the supporting guide means (9) and, when required, being operated upon by respective drive means (14) in such a way as to act on the bottom of the single filter bag (1) so that the latter moves upwards.

2. The machine according to claim 1, characterised in that the actuating means (12) comprise a lever (15), located under the plane defined by the supporting guide means (9) and pivoted, at (15*a*) at one end of it, to a machine frame (101) in such a way as to move, when acted upon by the drive means (14), between an idle position where the lever (15) is parallel with the supporting guide means (9), and a working position where the lever (15) rises and with its free end engages the guide means (9) in such a way as to contact and raise one of the filter bags (1).

3. The machine according to claim 2, characterised in that the free end of the lever (15) has a substantially wedge-shaped head (15*t*) forming an inclined surface (15*p*) so that when the lever (15) is in the raised position, the filter bag (1) is lifted as it goes in.

4. The machine according to claim 1, characterised in that the pick-up means (11) comprise a filter bag (1) ejector element (11) located between the first conveying means (8) and the supporting guide means (9); the ejector element (11) being at least driven in the feed direction (A) by a respective cam system (16) between a first pick-up position, where the ejector element (11) is positioned between the conveying means (8) and a respective filter bag (1), and a release position, where the ejector element (11) acts in conjunction with the guide means (9).

5. The machine according to claim 4, characterised in that the ejector element (11) comprises a pair of vertical teeth (17) for pushing the filter bag (1), associated with a base (18), in such a way as to form, together with the teeth (17), a U-shaped element controlled by the cam system (16) which drives it and coordinates its motion, between the pick-up position and the release position.

6. The machine according to claim 1, characterised in that the conveying means (8) comprise a first rotating drum (8); the first drum (8) having a plurality of cells (20), uniformly distributed on its circumferential surface, for receiving the individual filter bags (1).

7. The machine according to claim 6, characterised in that each of the cells (20) has two longitudinal grooves (21) which, when the cell (20) passes near the supporting guide means (9), accommodate two vertical teeth (17) constituting the pick-up means (11).

8. The machine according to claim 7, characterised in that each of the cells (20) on the drum (8) has a finger unit (22) on each side of it for retaining the filter bag (1) in the cell (20); each finger unit (22) being pivoted, at (22*a*), to a rigid arm (23) protruding laterally from the drum (8); each finger unit (22) being rotatable between a first, closed retaining position, where the finger unit (22) at least partially faces the filter bag (1) located in the cell (20) and engages, with its fingers (22*d*), respective lateral openings (20*a*) in the cell (20), and an open position for feeding/releasing the filter bag (1), where each finger unit (22) is away from the cell (20).

9. The machine according to claim 1, characterised in that the supporting guide means (9) are defined by a conveying channel (9) composed of a first, infeed section (30) having side walls (9*a*) converging towards the inside of the channel (9) itself and designed to retain the filter bag (1) temporarily in the infeed area, and a successive second section (24) whose passage width (L) is at least equal to the width (L1) of the filter bags (1) in transit.

10. The machine according to claim 9, characterised in that the base (24*b*) of the second section (24) at least partly cooperates with a portion (25*r*) of a power-driven conveyor belt (25) designed to permit the movement of the filter bags (1) in the feed direction (A) towards a filter bag (1) manual pick-up and handling area (10).

11. The machine according to claim 10, characterised in that the second section (24) is equipped with respective side walls (24*a*) that can be moved in order to adjust the passage width (L) according to the width (L1) of the filter bags (1).

12. The machine according to claim 1, characterised in that it comprises safety means (26) located close to the infeed end of the guide means (9), acting on a main control unit (27) of the machine (100) and designed to produce a signal (S) that stops the machine (100) in the event of a fault in the mechanism that moves/feeds the filter bags (1) into the guide means (9).

13. The machine according to claim 12, characterised in that the safety means (26) comprise a pair of parallel control rods (28) associated with a block (29) linked to the channel (9); the rods (28) being coupled with the guide means (9) on both sides of the pick-up means (11) and underneath the area where the filter bags (1) pass; the support block (29) being pivoted, at (29*a*) at one end of it, to the guide means (9) so as to allow the rods (28) to rotate if the filter bags (1) get jammed, thereby exerting on the rods (28) a downward pushing force that is greater than the retaining force exerted by the rods (28); a presence sensor (31) being associated with the guide means (9) and located near the pair of rods (28) when they are parallel to the channel (9) to generate a machine (100) stop signal (S) when the rods (28) are rotated downwards.

* * * * *

UNITED STATES PATENT AND TRADEMARK OFFICE

CERTIFICATE OF CORRECTION

PATENT NO. : 7,730,697 B2
APPLICATION NO. : 12/298107
DATED : June 8, 2010
INVENTOR(S) : Matteo Bernardi It is certified that error appears in the above-identified patent and that said Letters Patent is hereby corrected as shown below:

In column 6, line 39, in Claim 4, please delete "located between the first conveying means" and insert therefor --located between the conveying means--.

Signed and Sealed this

Seventh Day of September, 2010

David J. Kappos

David J. Kappos
*Director of the United States Patent and Trademark Office*